US005911215A

United States Patent [19]

Fisher, Jr.

[11] Patent Number: 5,911,215

[45] Date of Patent: Jun. 15, 1999

[54] ATTACHMENT MECHANISM FOR AN ACCESSORY FOR AN ARCHER'S BOW

[76] Inventor: James Conner Fisher, Jr., 150 Colonial Way, Calhoun, Ga. 30701

[21] Appl. No.: 08/808,386

[22] Filed: Feb. 28, 1997

[51] Int. Cl.[6] ..... F41B 5/14

[52] U.S. Cl. ..... 124/86

[58] Field of Search ..... 124/86, 88, 89; 403/321, 325, 327, 328; 411/433, 437

[56] References Cited

U.S. PATENT DOCUMENTS

| | | | |
|---|---|---|---|
| 422,361 | 3/1890 | Alton . | |
| 856,436 | 6/1907 | Walden . | |
| 924,122 | 6/1909 | Williams . | |
| 2,218,319 | 10/1940 | Pfauser . | |
| 2,664,768 | 1/1954 | Clyne . | |
| 2,671,482 | 3/1954 | Gordon . | |
| 3,412,725 | 11/1968 | Hoyt | 124/89 |
| 3,524,441 | 8/1970 | Jeffery | 124/89 |
| 3,570,836 | 3/1971 | Pettavel . | |
| 4,693,656 | 9/1987 | Guthrie | 411/433 |
| 5,239,977 | 8/1993 | Thomas | 124/89 |
| 5,558,078 | 9/1996 | Dunlap | 124/89 |
| 5,657,741 | 8/1997 | Todd | 124/89 |

OTHER PUBLICATIONS

Machine Design Magazine, Apr. 18, 1996, p. 188, "Push-button Stop Nut".

*Primary Examiner*—John A. Ricci

*Attorney, Agent, or Firm*—Chambliss, Bahner & Stophel, P.C.

[57] ABSTRACT

The invention comprises a quick-release locking device for attachment of an accessory having a threaded shaft at one end thereof to an archer's bow. This locking device includes a body having a bore extending therein, which bore is sized so that the shaft of the accessory may be inserted therein. The device also includes a shaft engagement mechanism within the body which is adapted to engage the threads of the shaft of the accessory within the bore, and a manually operable release mechanism within the body which may be actuated to release the engagement mechanism from the shaft. The locking device may be incorporated into the handle or riser of a bow, or it may be provided in the form of an attachment that can be threaded into the existing accessory hole of a conventional bow.

28 Claims, 9 Drawing Sheets

ATTACHMENT MECHANISM FOR AN ACCESSORY FOR AN ARCHER'S BOW

FIELD OF THE INVENTION

This invention relates to an archer's bow, and more particularly, to the attachment of accessories such as a stabilizer to the bow.

BACKGROUND OF THE INVENTION

Archers and bowhunters are constantly seeking new developments that can improve the accuracy and the stealth of their shooting. Consequently, sighting devices, release mechanisms, stabilizers and other accessories have been developed to improve bow shooting. Many of these accessories are provided with a threaded shaft for attachment to the bow. Consequently, the handle or riser of the bow may therefore be provided with one or more threaded attachment holes to permit attachment of the various accessories.

One such accessory is a stabilizer that is designed to counterbalance the bow and to reduce vibration attendant to its use. The simplest stabilizers are generally weighted cylinders or rods that are attached to the front or the rear of the riser of the bow. Some stabilizers are designed to be used in pairs, one being attached to the upper part of the riser, and the other being attached to the lower part. Other stabilizers are designed to be used alone, and single stabilizers are usually attached to the front of the riser below the arrow rest. Stabilizers may be provided in different lengths, weights, shapes and configurations. Some may include appendages that depend from the front of the stabilizer; however, all are designed to counterbalance the weight of the bow and most are also designed to dampen vibrations from the strings of the bow. In addition, virtually all are provided with a threaded shaft at one end thereof that may be threaded into a threaded hole in the front or the rear of the riser for attachment to the bow. The standard configuration for these holes is 0.3125–24, with a diameter of 0.3125 inches (7.9 mm) and 24 TPI (threads per inch).

Other accessories that have a threaded shaft for attachment to the riser of the bow using the same or a different threaded attachment hole include cameras and other items of photographic equipment, sighting devices and game tracking devices. Sighting devices are generally attached to a threaded hole provided in the side of the riser. The standard configuration for this hole is No. 10–32, with a diameter of 0.190 inches (4.8 mm) and 32 TPI (threads per inch). Most of the other accessories are attached to a 0.3125–24 threaded hole provided in the front of the riser.

Although such accessories are usually provided with a threaded shaft that is adapted for mating engagement with a threaded attachment hole in the riser of a bow, it is conceivable that they could be provided with a flange having a bolt hole and a separate bolt that is adapted for mating engagement with an attachment hole. For purposes of the discussion herein, such alternative means of attachment are considered to be equivalent. As used herein therefore, "accessories having a threaded shaft at one end thereof" shall include accessories that are attachable using a separate threaded bolt.

Because stabilizers and other accessories are sometimes long or bulky, it is frequently desirable to attach the accessory only when use of the bow is imminent, and to remove it for transportation or storage of the bow. Therefore, the user of a stabilizer, for example, generally has to thread its shaft all the way into the threaded hole to attach it, and reverse the process to remove it. As an alternative, hinged or articulating adapters have been developed that may be threaded into the attachment hole in the riser and into which the stabilizer may also be threaded. These hinged adapters may be articulated from a first position in which the stabilizer extends from the front of the bow to a second position in which the stabilizer is folded out of the way. These adapters also include a mechanism that locks the hinge in either of the first or second positions. Once installed, these hinged adapters do not permit ready or easy removal of the stabilizer or other accessory. They merely permit the installed stabilizer to be folded out of the way.

Other adapters have been developed to provide a more convenient means of attachment and removal of the stabilizer or other accessory, but these adapters employ a plurality of separate components. A first component typically comprises a female-threaded member that is threaded onto the threaded shaft of the accessory. The second component includes a body having a slot or socket into which the first component may be removably placed, and a mechanism for tightening the first component in the socket. The second component also is provided with a male-threaded member that may be threaded into the attachment hole of the bow. The stabilizer or other accessory that is attached to the bow using one of these adapters may be removed from the bow by disengaging the tightening mechanism and removing the accessory, and the first component that is attached to the accessory, from the second component. In order to use the accessory on the bow at a later time, the first component is mated with the second component and the tightening mechanism engaged to hold the components together. This procedure takes about as much time as would be required to attach an accessory to the bow by threading its threaded shaft into the attachment hole, or to remove it by reversing the process. Furthermore, it requires that the first component of the adapter be attached to the shaft of the accessory in a more-or-less permanent attachment. This prevents an archer from using, from time to time, the same accessory on a plurality of bows or a plurality of accessories on the same bow, unless all are equipped with the same type of adapter assembly.

It would be desirable, therefore, if a mechanism could be developed that would permit easy and quick attachment and detachment of an accessory having a threaded shaft at one end thereof, such as a stabilizer, to a bow. It would also be desirable if such a mechanism could be developed that would permit the accessory to be easily and securely locked into place on the bow. It would also be desirable if such a mechanism could be developed that would permit easy and quick attachment and detachment of such an accessory without requiring that the accessory be altered or fitted with any components in a more-or-less permanent attachment.

Such an improved mechanism may permit the development and use of new or improved accessories. For example, bow fishermen frequently attach a type of tracking device that resembles a fishing reel to the front attachment hole in the riser. A line from the reel is then attached to an arrow so that if the fisherman hits his target, he can retrieve the fish and his arrow by pulling on the line. An improved mechanism of the type contemplated herein would permit a bow fisherman to attach an ordinary fishing reel mounted on a short rod to the bow. Once a fish was speared with an arrow, the fisherman could quickly detach his rod from the bow and easily reel in his fish.

OBJECTS AND ADVANTAGES OF THE INVENTION

Accordingly, it is an object of the invention claimed herein to provide an improved mechanism for easy and quick attachment and detachment of an accessory having a threaded shaft at one end thereof to a bow. It is another object of the invention to provide such a mechanism that permits the accessory to be easily and securely locked into place on the bow. It is yet another object of the invention to provide such a mechanism that permits easy and quick attachment and detachment of a bow accessory without requiring that the accessory be altered or fitted with any components in a more-or-less permanent attachment.

Additional objects and advantages of this invention will become apparent from an examination of the drawings and the ensuing description.

SUMMARY OF THE INVENTION

The invention comprises a quick-release locking mechanism for attachment of an accessory having a threaded shaft at one end thereof to an archer's bow. This mechanism includes a body having a bore extending therein, which bore is sized so that the shaft of the accessory may be inserted therein. The mechanism also includes shaft engagement means within the body which are adapted to engage the threads of the shaft of the accessory within the bore, and manually operable release means within the body which may be actuated to release the engagement means from the shaft. The mechanism may be incorporated into the handle or riser of a bow, or it may be provided in the form of an attachment that can be threaded into the existing accessory hole of a conventional bow.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
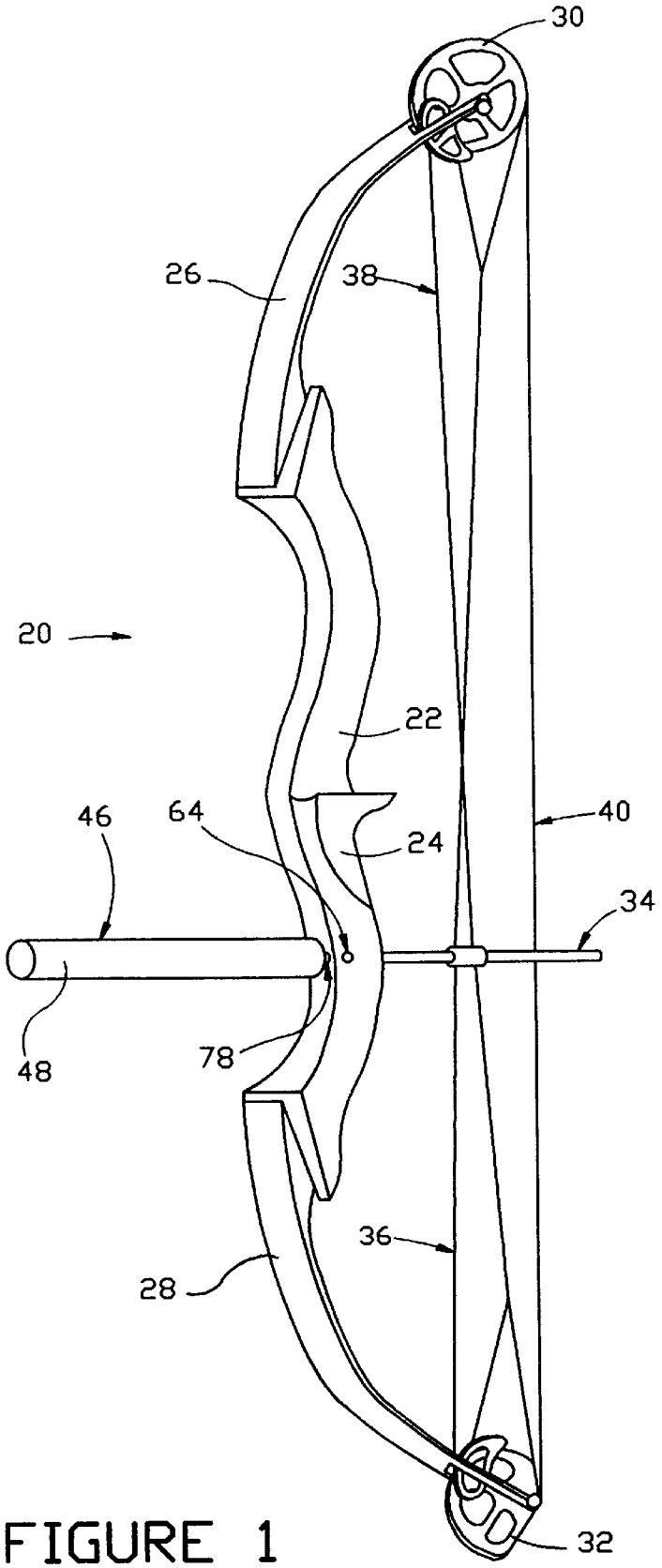
FIG. 1 is a perspective view of an archer's bow that is equipped with a stabilizer, which accessory is mounted in accordance with a preferred embodiment of the invention.

Referring now to the drawings, FIG. 1 illustrates a typical compound bow 20 such as may be used for target shooting or for hunting. Bow 20 includes handle or riser 22, which includes grip 24, and to which are attached upper limb 26 and lower limb 28. A pair of pulley assemblies 30 and 32 are rotatably mounted in slots formed in the ends of limbs 26 and 28 respectively. String stabilizer 34 is mounted so as to extend from the rear of riser 22 and includes two slots (not shown) to accommodate strings 36 and 38. Each of strings 36 and 38 is divided at one end for attachment to an end of a limb, and is attached to draw string 40 at the other end. Thus, string 36 is attached at its divided end to the end of upper limb 26 and at its other end (not shown) to draw string 40. Similarly, string 38 is attached at its divided end to the end of lower limb 28 and at its other end (not shown) to draw string 40. The attachment of an end of string 40 to each of the other two strings allows pulley assemblies 30 and 32 to combine the effect of the strings.

Figure 2:
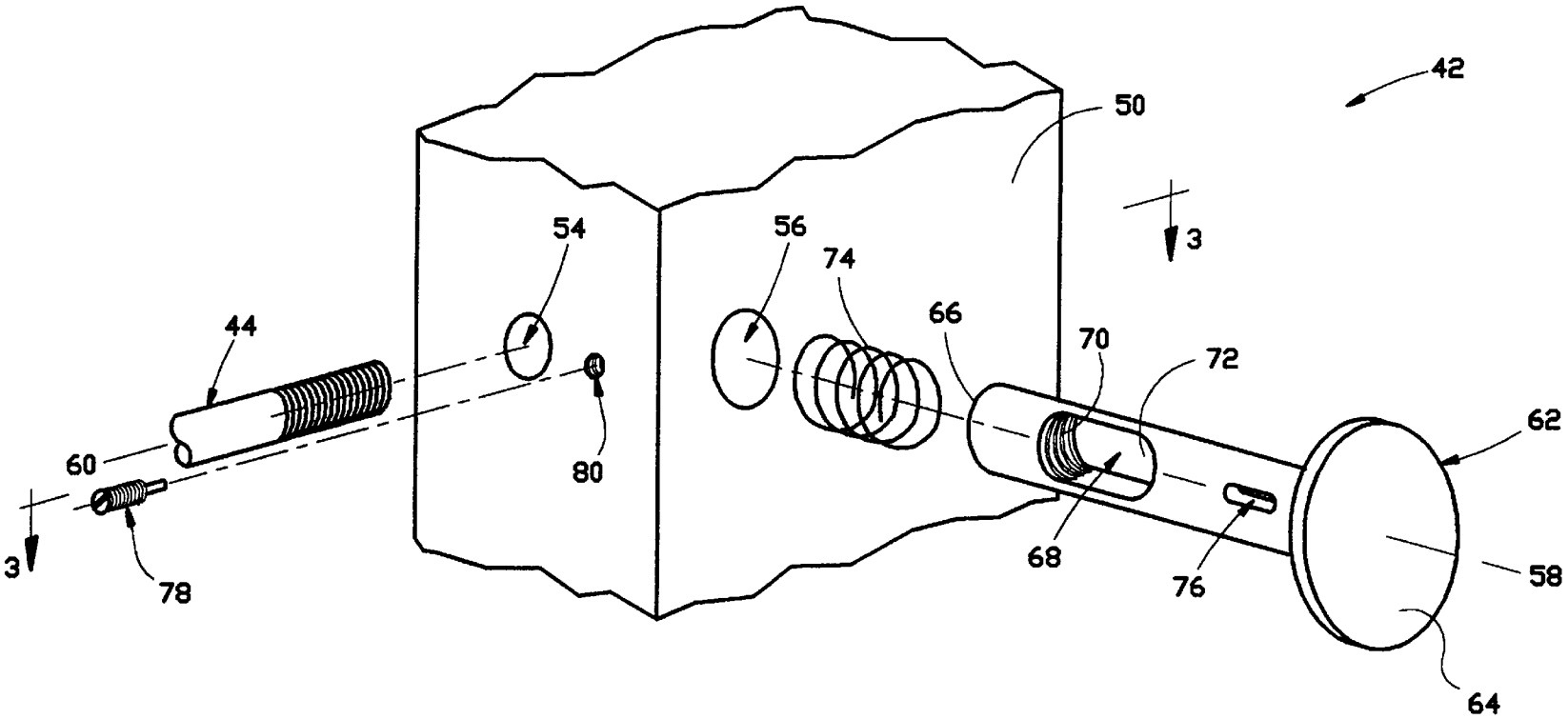
FIG. 2 is an exploded perspective view of the embodiment of the invention that is incorporated into the bow of FIG. 1, but showing only a portion of the bow and the accessory that is illustrated therein.
Figure 3:
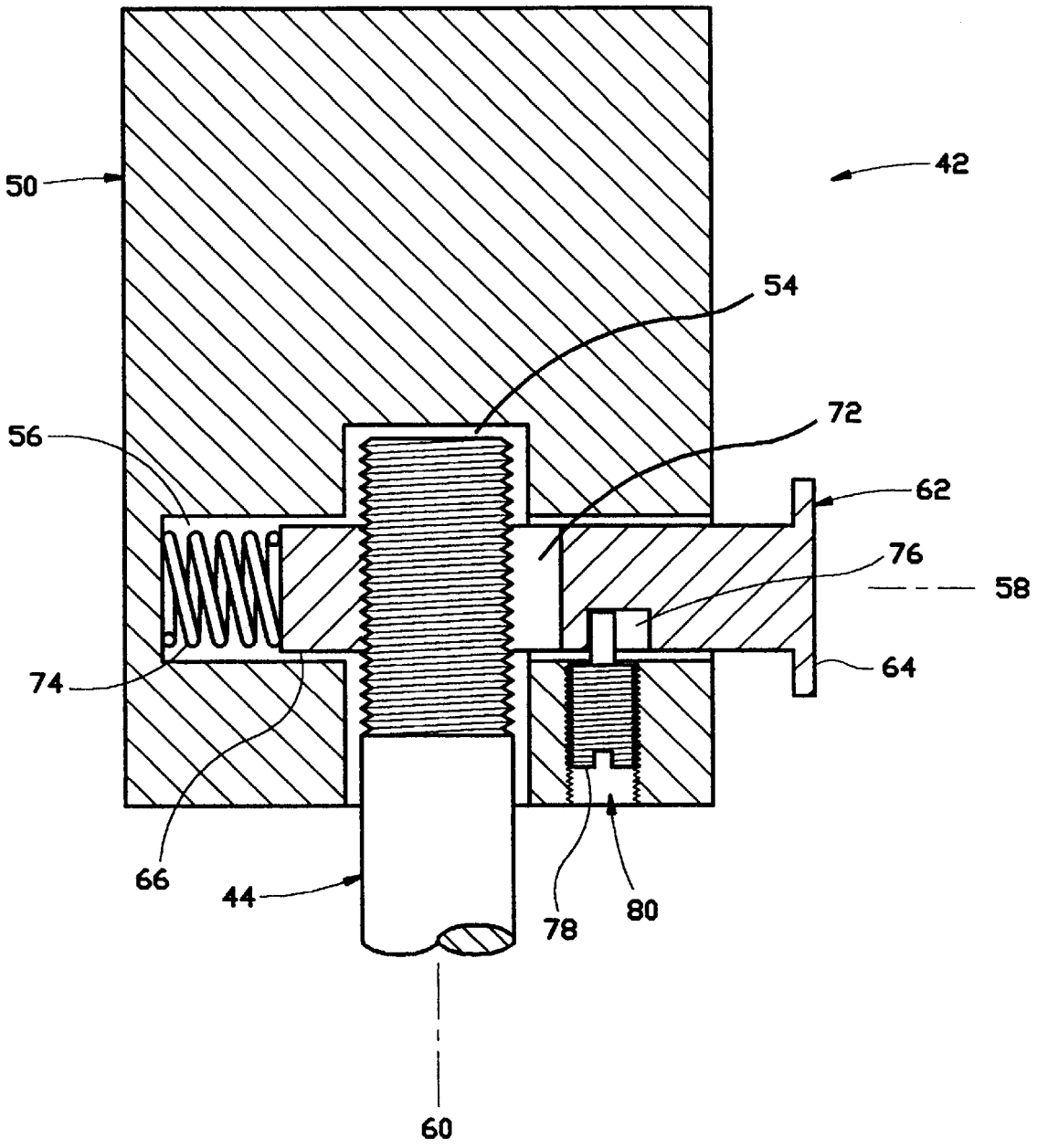
FIG. 3 is a sectional view of the embodiment of the invention that is illustrated in FIGS. 1 and 2, as viewed from the perspective of lines A—A of FIG. 1 and lines 3—3 of FIG. 2.

FIGS. 1, 2 and 3 illustrate a preferred embodiment 42 of the invention, which may be used for quick and secure attachment and easy detachment of any accessory having a threaded shaft 44 (FIGS. 2 and 3) at one end. Stabilizer 46 (shown in FIG. 1) is such an accessory, which includes a generally cylindrical body portion 48, and a threaded shaft at one end thereof (not shown in FIG. 1). Although not illustrated herein, the invention may also be used in connection with a stabilizer or other accessory that is adapted to be attached to a bow using a separate bolt. Mechanism 42 includes body 50, which is incorporated within the riser 22 of bow 20. Although not illustrated herein, the invention could also be incorporated within the riser or handle of a longbow or a recurve bow.

The body of the mechanism could also be provided in the form of a separate structure (such as is shown for another embodiment of the invention in FIGS. 10, 11 and 12) that includes a bolt which is threaded so as to be adaptable for threaded insertion into a threaded accessory hole of a bow.

Body 50 has a first bore 54 extending therein, which bore is sized so that the shaft 44 of the accessory may be inserted therein. As shown in FIGS. 2 and 3, the first bore has a generally cylindrical cross-section with a diameter that is at least as large as the major diameter of the shaft of the accessory, so that the shaft may be inserted therein. Preferably, the first bore extends into the body to a depth at least as great as the length of the threaded shaft of the accessory.

The body of mechanism 42 also has a second bore 56 extending therein. The second bore has an axis 58 that is disposed transverse to the axis 60 of the first bore, and as shown in FIG. 3, the two bores 54 and 56 also intersect with each other. The second bore may be generally cylindrical, as shown in FIGS. 2 and 3, or it may be provided in any convenient non-cylindrical shape.

Mechanism 42 also includes shaft engagement means within the body which are adapted to engage the threads of the shaft of the accessory within the bore, and manually operable release means within the body which may be actuated to release the engagement means from the shaft. As best shown in FIGS. 2 and 3, the shaft engagement means and release means include plunger 62 that is disposed within second bore 56 and adapted for movement within and along axis 58 of the second bore. The plunger has an outer end 64 that is manually accessible from the periphery of body 50, on the side of riser 22 as shown in FIG. 1. Plunger 62 also has an inner end 66 that is disposed within the body and an axis extending between outer end 64 and inner end 66. As shown best in FIG. 2, the axis between the outer end 64 and the inner end 66 of plunger 62 in this embodiment of the invention is coincident with axis 58 of second bore 56. Obviously, plunger 62 has a shape that is congruent to that of second bore 56. Therefore, if the second bore is provided with a square or hexagonal cross-section, for example, plunger 62 will be shaped so as to fit and be moveable therein.

Plunger 62 is provided with an aperture 68, as shown in FIG. 2. This aperture goes through the plunger in a direction transverse to the axis of the plunger at a location between the outer and inner ends of the plunger. Aperture 68 has an inner portion 70 and an outer portion 72. The inner portion 70 is located on the side of aperture 68 adjacent to the inner end portion 66 of plunger 62. Inner portion 70 of aperture 68 has a partially cylindrical cross-section that is provided with threads adjacent to said inner end portion. Since these threads are adapted for engagement with the threads of shaft 44, inner portion 70 has a major diameter (measured between the threads) at least as large as the major diameter (measured across the threads) of the shaft of the accessory. Furthermore, inner portion 70 is preferably provided with internal threads through a cross-sectional arc of at least about 22.5° and no more than 180°. In addition, these threads are preferably provided with a standard configuration of 0.3125–24.

Outer portion 72 is located on the side of aperture 68 adjacent to outer end 64 of plunger 62, and is provided with a cross-section which is at least as wide as the major diameter of the inner portion. Plunger 62 is moveable within the second bore between an engaged position (shown in FIG. 3), with the inner portion 70 of aperture 68 in alignment with first bore 54 to permit partial engagement of the threads of shaft 44 of an accessory that is inserted within the first bore with the threads of inner portion 70, to a released position (not shown), with the outer portion 72 of the aperture in at least partial alignment with the first bore to permit axial movement of the threaded shaft on an accessory within the first bore.

Mechanism 42 also includes biasing means adapted to apply a biasing force to plunger 62 to urge the plunger outwardly in an axial direction along second bore 56 to the engaged position illustrated in FIG. 3. The action of the biasing means permits plunger 62 to be disposed within the second bore in the engaged position shown in FIG. 3 unless outer end 64 of the plunger is depressed against the bias of the biasing means to move the plunger to the released position. Preferably, the biasing means is provided in the form of compression spring 74, as shown in FIGS. 2 and 3. In the alternative, the biasing means may be provided as a washer that resists compression, or by any other means known to those skilled in the art to which the invention relates for providing a biasing force to urge the plunger outwardly in an axial direction along the second bore.

Mechanism 42 also includes retaining means adapted to maintain plunger 62 within second bore 56. As shown in FIGS. 2 and 3, a preferred retaining means is provided by the combination of slot 76, that is located in plunger 62 between aperture 68 and outer end 64, and a pin that is fixed within the body and which extends transversely into the slot. Preferably, the pin is provided in the form of dog-point set screw 78 that is threaded into threaded pin aperture 80, as shown in FIGS. 2 and 3. In the alternative, the pin may be a roll pin or a split-roll pin that is force fit into a non-threaded aperture (not shown). In such event, it may be desirable to have slot 76 extend all the way through plunger 62 (not shown), so that the pin may be secured within body 50 on both sides of bore 56. In any event, the pin is located within the body so as to extend into or through slot 76, so that axial movement of the plunger within the second bore is limited by the length of the slot along the axis of the second bore.

Although not shown in the drawings, another embodiment of the invention could be provided with a second bore that extends all the way through the riser of the bow. Such embodiment may be necessary where the riser of the bow is of insufficient material thickness to accommodate all of the internal components of mechanism 42. In such event, the plunger could extend all the way through the body of the mechanism. A compression spring could be provided that would wrap or coil around the portion of the plunger extending out of the body and bear against and between the inside of manually accessible outer end 64 and the outer periphery of the body. The retaining means could then be provided in the form of a rim or lip on inner end 66, or a retaining ring, such as a snap ring, spiral ring or E-style clip, that is disposed in a groove provided around the plunger near inner end 66.

When shaft 44 is inserted into the bore of the body of mechanism 42 (or any other embodiment of the invention in which the engagement means includes a threaded member) and the engagement means are employed to secure the shaft therewithin, it is preferred that the shaft be manually turned radially by a small amount (approximately one-quarter turn) in the tightening direction in order to insure that the threads of the engagement means are properly aligned with the threads of the shaft for maximum security of the attachment of the accessory to the bow.

Figure 4:
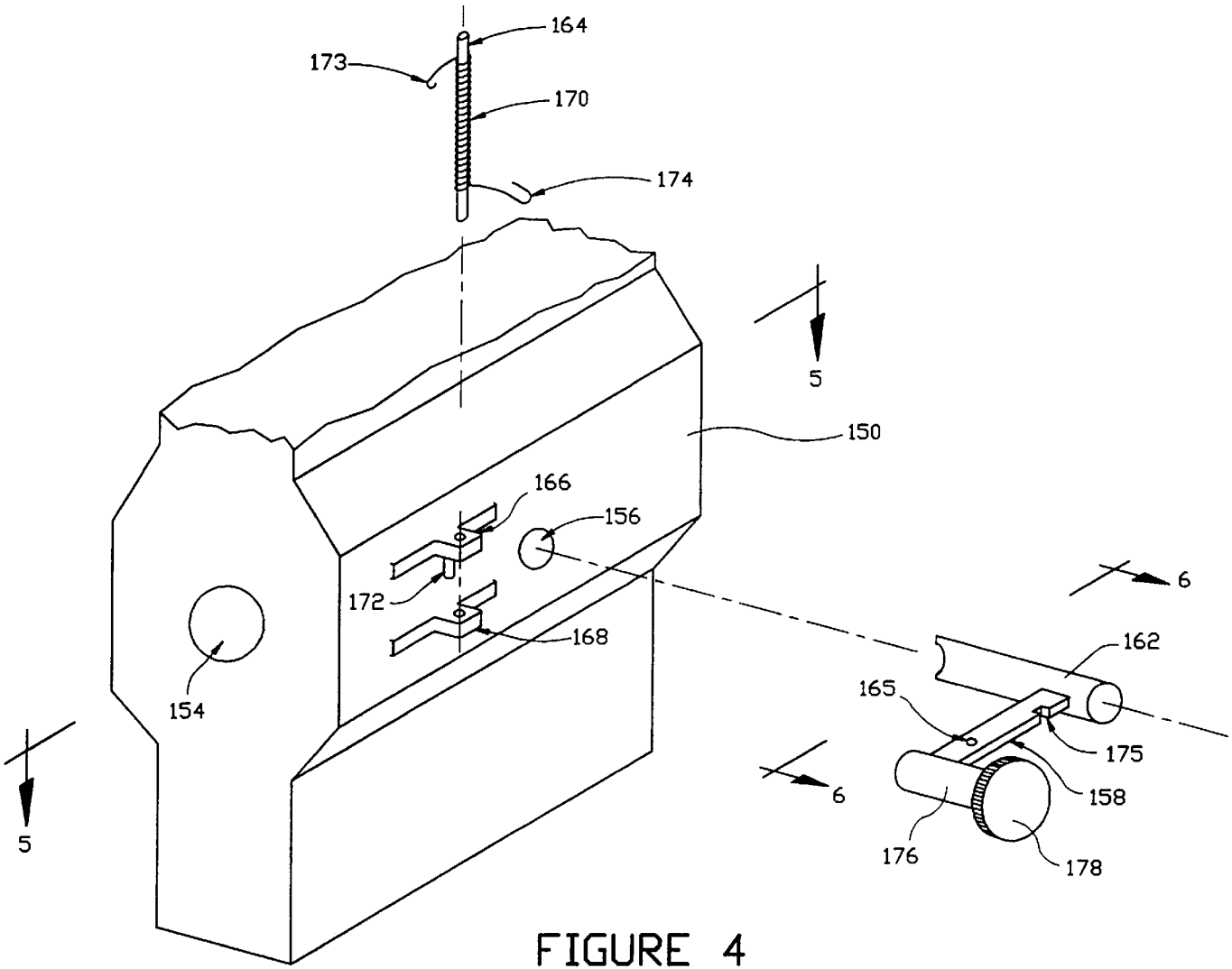
FIG. 4 is an exploded perspective view of an alternative embodiment of the invention that is incorporated into a bow, such as the bow of FIG. 1.
Figure 5:
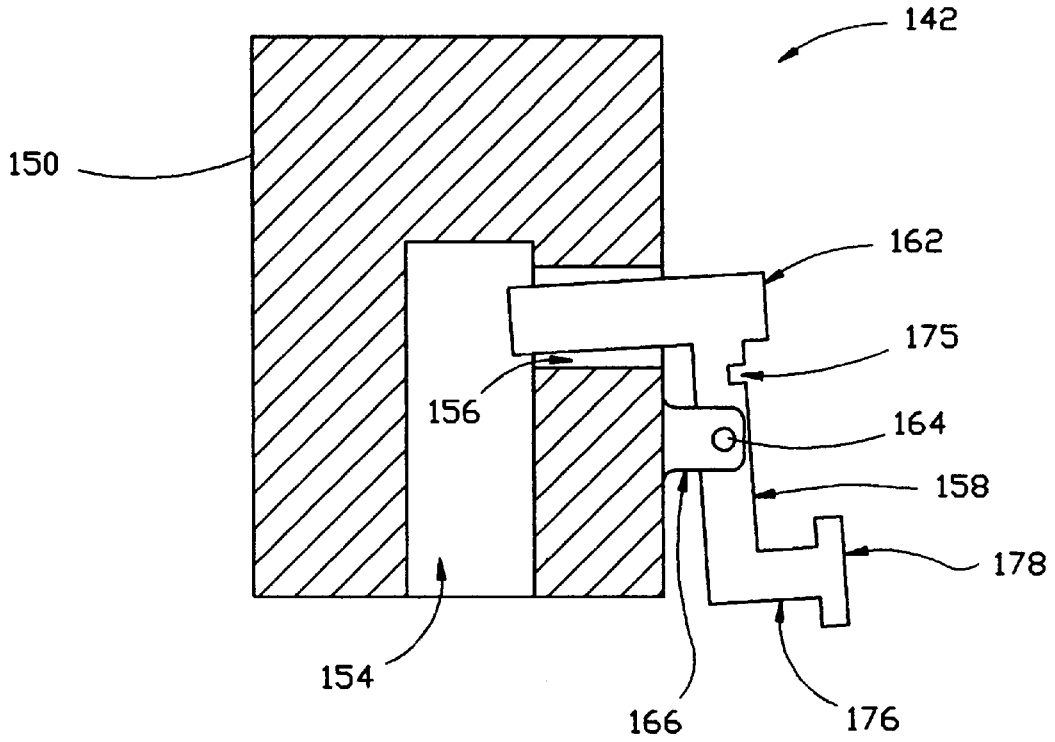
FIG. 5 is a sectional view of the embodiment of the invention that is illustrated in FIG. 4, as viewed from the perspective of lines 5—5 of FIG. 4.
Figure 6:
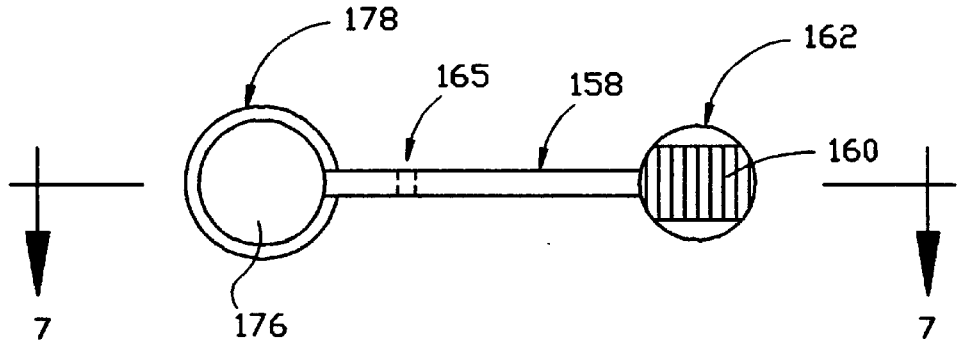
FIG. 6 is a sectional view of a portion of the shaft engagement means of the embodiment of the invention that is illustrated in FIGS. 4 and 5, as viewed from the perspective of lines 6—6 of FIG. 4.

FIGS. 4, 5 and 6 illustrate a second embodiment 142 of the invention, which may be used for quick and secure attachment and easy detachment of any accessory having a threaded shaft at one end, such as shaft 44 of FIGS. 2 and 3.

Mechanism 142 includes body 150, which is adapted to be incorporated within the riser of a bow such as bow 20. The body of mechanism 142 could also be provided in the form of a separate structure (such as is shown for another embodiment of the invention in FIGS. 10, 11 and 12) that includes a bolt which is threaded so as to be adaptable for threaded insertion into a threaded accessory hole of a bow.

Body 150 has a bore 154 extending therein, which bore is sized so that the shaft of the accessory may be inserted therein. As shown in FIGS. 4 and 5, the bore has a generally cylindrical cross-section, and it should have a diameter that is at least as large as the major diameter of the shaft of the accessory, so that the shaft may be inserted therein. Preferably, bore 154 extends into the body to a depth at least as great as the length of the threaded shaft of the accessory.

Body 150 of mechanism 142 is also provided with a cavity that is located adjacent to and in communication with the bore. As shown in FIGS. 4 and 5, this cavity may be provided in the form of a second generally cylindrical bore 156 that intersects with and is generally oriented at right angles to bore 154. In the alternative, the cavity may be provided in any other convenient form. Mechanism 142 also includes shaft engagement means within the body which are adapted to engage the threads of the shaft of the accessory within bore 154, and manually operable release means within the body which may be actuated to release the engagement means from the shaft.

Figure 7:
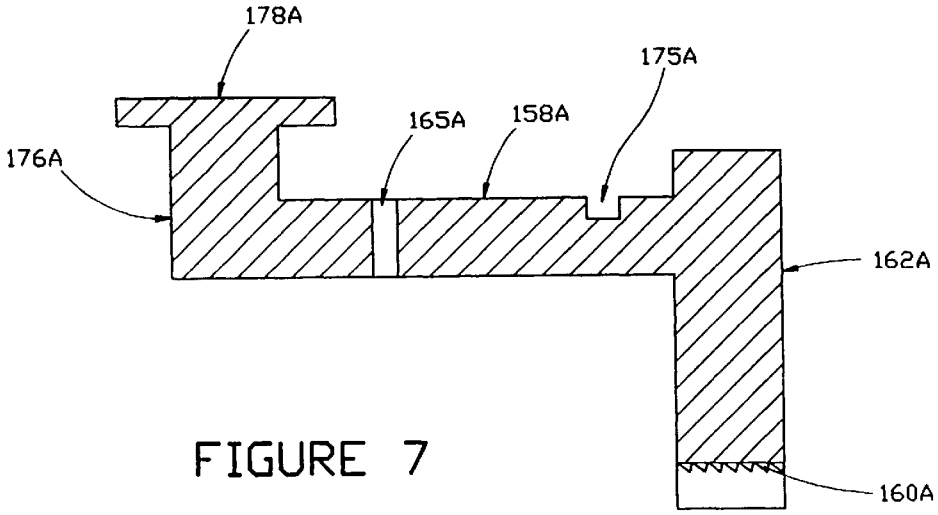
FIG. 7 is a sectional view of a portion of the shaft engagement means of the embodiment of the invention that is illustrated in FIG. 6, as viewed from the perspective of lines 7—7 of FIG. 6.

The shaft engagement means of mechanism 142 includes elongate arm 158 having a plurality of thread-engaging teeth 160 at one end thereof. Preferably, as shown in FIG. 6, the teeth are provided in the form of 0.3125–24 threads that are cut into first cylindrical arm projection 162. In the alternative, the teeth may be cut so is to be inclined away from the mouth of bore 154 at the periphery of the body. Such an alternative embodiment of the shaft engagement means of the invention is illustrated in FIG. 7, which will be discussed in more detail subsequently.

Arm 158 is pivotally attached to the body, by means of pin 164 that is inserted through pinhole 165 and secured by a clevis, comprised of upper clevis portion 166 and lower clevis portion 168. Pin 164 permits arm 158 to be pivoted from an engaged position in which the teeth engage the threads of a shaft in bore 154 to a released position in which the teeth are released from engagement with the threads.

Mechanism 142 also includes biasing means adapted to apply a biasing force to arm 158 to urge arm projection 162 inwardly along second bore 156 to the engaged position illustrated in FIG. 5. Preferably, the biasing means is provided in the form of torsion spring 170, as shown in FIG. 4, which is placed around pin 164. End 173 of torsion spring 170 is configured to be secured to spring pin 172 of clevis portion 166, and end 174 is configured to be secured in slot 175 of elongate arm 158.

The release means of mechanism 142 includes second arm projection 176 which is connected to elongate arm 158 at the end opposite first arm projection 162. Preferably, arm projection 176 is generally cylindrical, as shown in FIGS. 4, 5 and 6. Arm projection 176 projects from elongate arm 158 outwardly from the body to terminal knob 178 which is manually engageable to cause arm projection 176 to pivot elongate arm 158 from the engaged position in which the teeth engage the threads of a shaft in the bore to the released position in which said teeth are released from engagement with said threads.

Figure 10:
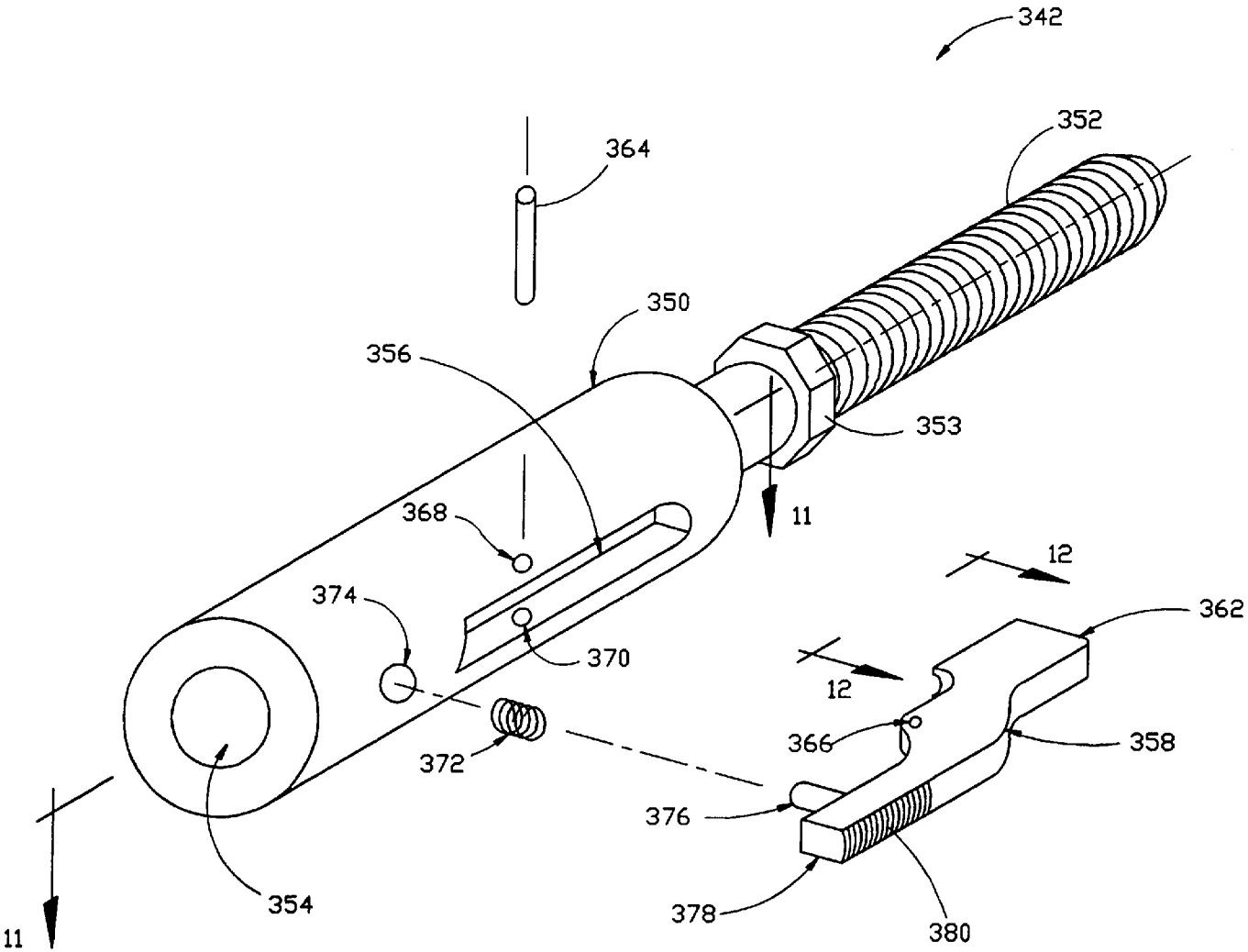
FIG. 10 is an exploded perspective view of an alternative embodiment of the invention that is intended to be used in connection with a conventional threaded attachment hole for a bow.
Figure 11:
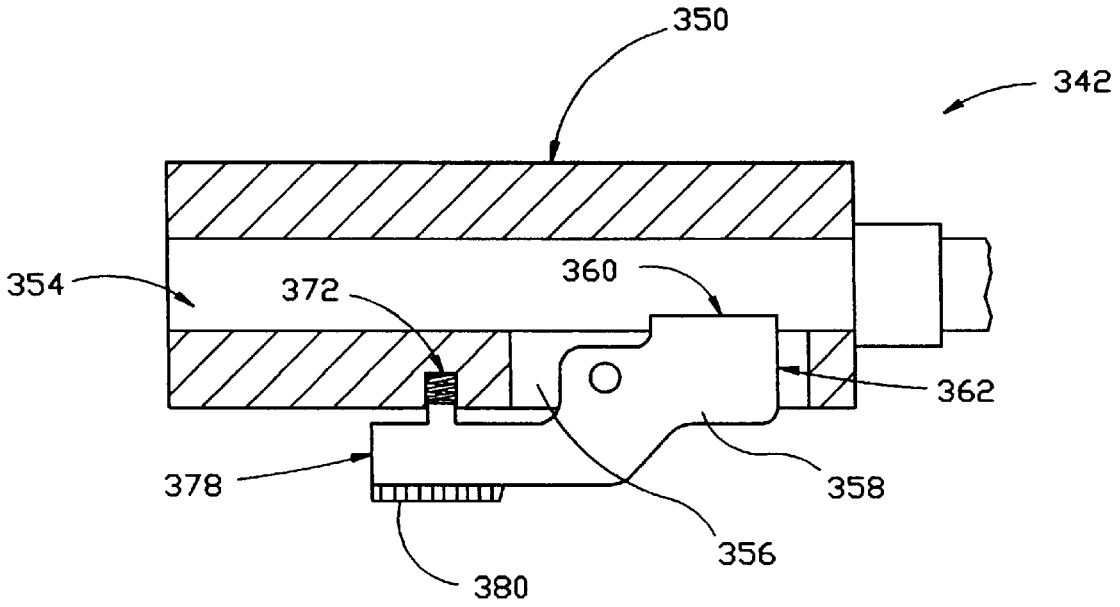
FIG. 11 is a sectional view of the embodiment of the invention that is illustrated in FIG. 10, as viewed from the perspective of lines 11—11 of FIG. 10.

Although the portion of the embodiment of the invention illustrated in FIGS. 4, 5 and 6 includes torsion spring 170, the biasing means may be provided by any other means known to those skilled in the art to which the invention relates, such as in the form of a compression spring (not shown) that may be mounted at the base of projection 176. Such a spring will act to urge projection 176 away from body 150, and thereby to urge projection 162 inwardly along bore 156 to the engaged position. A similar arrangement is illustrated in FIGS. 10 and 11 in connection with another embodiment of the invention. However, regardless of the biasing means employed, the action of the biasing means permits projection 162 to be disposed within the second bore in the engaged position shown in FIG. 5 unless terminal knob 178 is depressed against the bias of the biasing means to move the projection outwardly along bore 156 to the released position.

FIG. 7 illustrates an alternative embodiment of a portion of the engagement means that may be employed in connection with mechanism 142. As shown therein, elongate arm 158A with its first arm projection 162A, pinhole 165A, slot 175A, second arm projection 176A and terminal knob 178A is viewed from the perspective of lines 7—7 of FIG. 6. Essentially, this embodiment of the portion of the engagement means is identical to that of mechanism 142 illustrated by FIGS. 4, 5 and 6, except for the teeth provided in the end of projection 162A. Teeth 160A are cut so as to be inclined away from the mouth of bore 154 at the periphery of the body. This permits arm 158A to present the teeth to the adjacent bore within the body of the mechanism in such manner that when the arm is in the engaged position, the shaft may be readily inserted into the bore without interference by the teeth with such insertion. When the shaft is in the bore, however, the teeth will engage the threads of the shaft so that the shaft may not be withdrawn from the bore unless the arm is in the released position.

Figure 8:
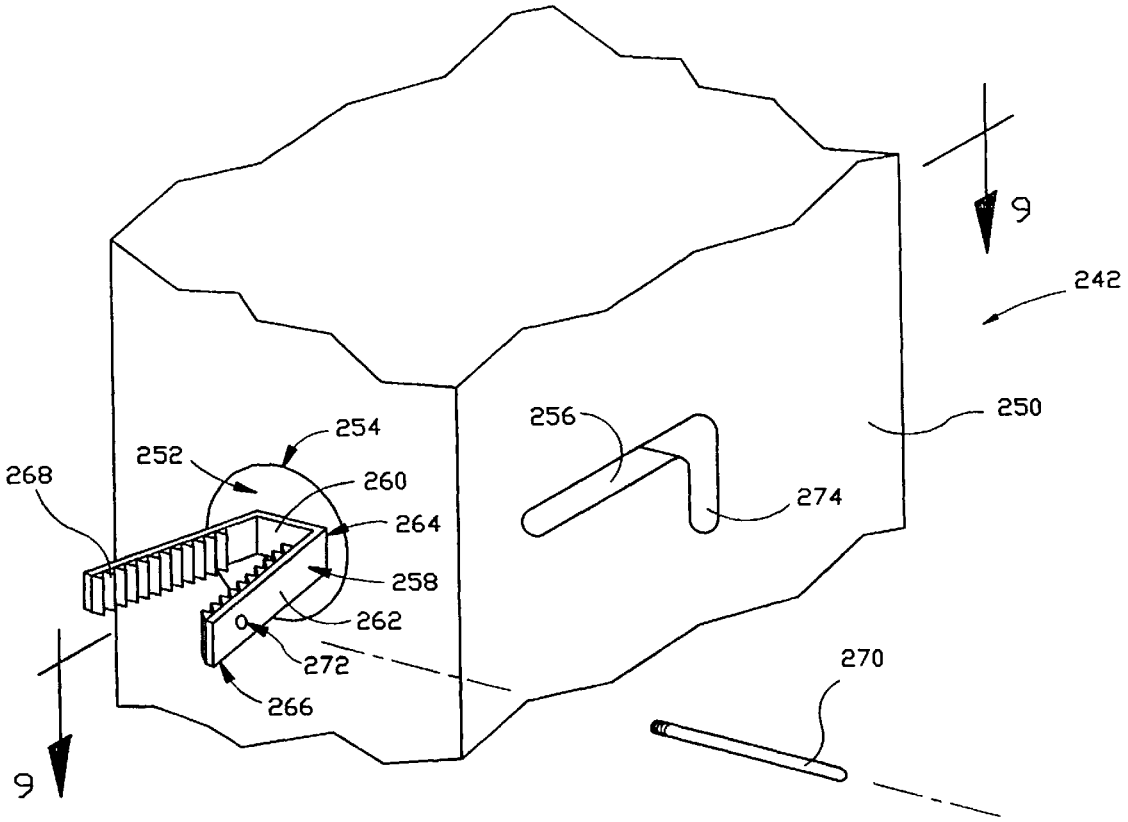
FIG. 8 is an exploded perspective view of an alternative embodiment of the invention that is incorporated into a bow, such as the bow of FIG. 1.
Figure 9:
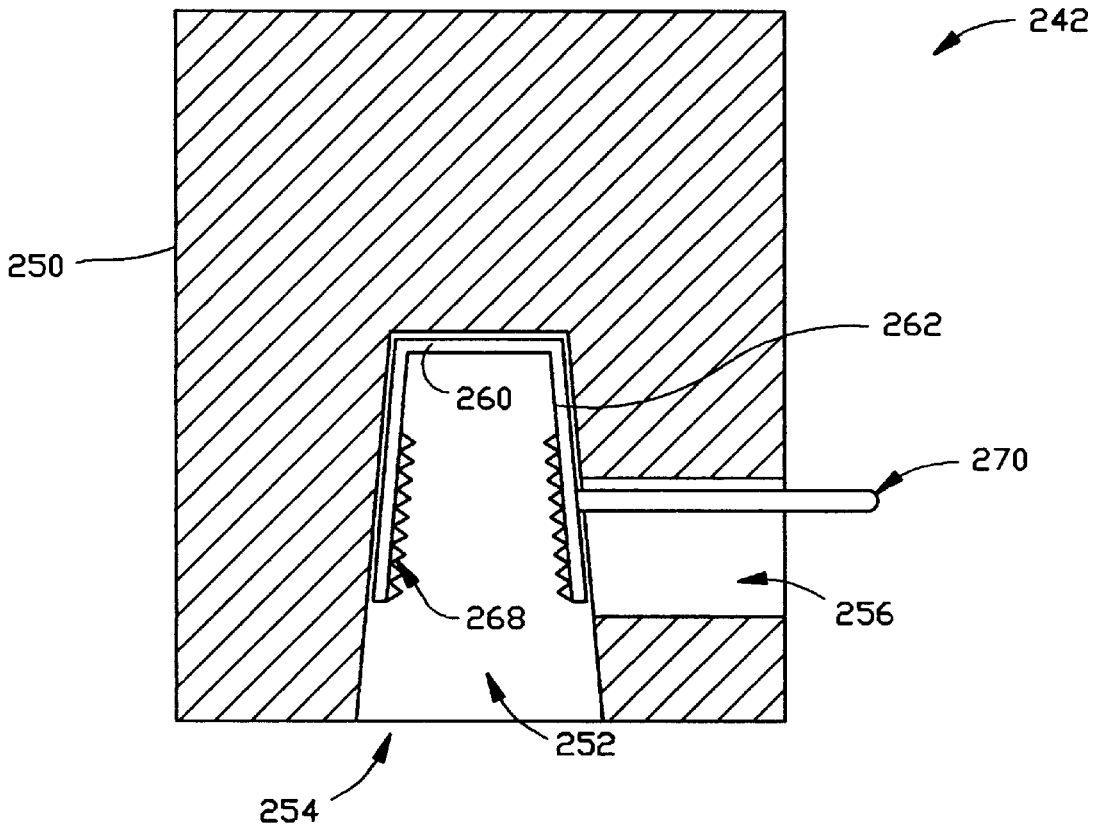
FIG. 9 is a sectional view of the embodiment of the invention that is illustrated in FIG. 8, as viewed from the perspective of lines 9—9 of FIG. 8.

FIGS. 8 and 9 illustrate a third embodiment 242 of the invention, which may be used for quick and secure attachment and easy detachment of any accessory having a threaded shaft of defined or known length at one end, such as shaft 44 of FIGS. 2 and 3.

Mechanism 242 includes body 250, which is adapted to be incorporated within the riser of a bow such as bow 20. The body of mechanism 242 could also be provided in the form of a separate structure (such as is shown for another embodiment of the invention in FIGS. 10, 11 and 12) that includes a bolt which is threaded so as to be adaptable for threaded insertion into a threaded accessory hole of a bow.

Body 250 has a bore 252 extending therein, which bore tapers inwardly from a mouth 254 at the periphery of the body. Preferably, bore 252 is in the shape of a truncated cone. Bore 252 is sized so that the shaft of an accessory may be inserted therein, and mouth 254 has a diameter that is larger than the major diameter of the shaft. As shown in FIG. 9, the width of bore 252 decreases as the bore tapers inwardly from mouth 254, so that the width of the bore, at a point within the body located a distance from the mouth that is greater than the defined length of the shaft, is smaller than the major diameter of the shaft. Body 250 also includes a slot 256 that extends generally along the side of the body in a direction parallel to the axis of bore 252. This slot is also in communication with the bore.

Mechanism 242 also includes shaft engagement means within the body which are adapted to engage the threads of the shaft of the accessory within the bore. The shaft engagement means includes an insert 258 that is adapted to fit within the tapered bore. The insert includes a base portion 260 having a width that is not larger than, and preferably smaller than, the major diameter of the shaft. The insert includes a plurality of projections, and any convenient number (larger than one) of such projections may be selected. Insert 258 of the embodiment illustrated in FIGS.

8 and 9 includes two such projections 262, each of which has a first end 264 and a second end 266. Each of these projections are attached to base portion 260 at the first end 264 so that second end 266 is disposed towards the mouth of the bore in a direction generally along the inner surface of the bore (as best shown in FIG. 9). Furthermore, the projections are spaced around the periphery of the base portion, and preferably, they are equally spaced therearound. Each of the projections is provided with a plurality of thread engaging means that are adapted to engage the threads of the shaft, such as teeth 268. In another embodiment of the invention, the insert may be provided in the form of a collet (not shown) having a plurality of projections depending from a base portion and being internally threaded with threads that are adapted to engage the threads of the shaft, such as, for example, with No. 24 threads.

Mechanism 242 also includes manually operable release means within the body which may be actuated to release the engagement means from the shaft. As shown in FIGS. 8 and 9, the release means preferably comprises a slide pin 270 which is attached to the insert, preferably by being threaded into aperture 272 in one of the projections. Slide pin 270 extends through slot 256 in a direction transverse to the axis of the bore, and is adapted to move the insert axially along the bore so that the second end 266 of the projections will move apart as the base portion 260 of the insert is moved towards the mouth 254 of the bore. The axial movement of the insert is limited by the length of slot 256 along the axis of the tapered bore.

Preferably, as shown in FIG. 8, body 250 is provided with primary slot 256 that extends generally along the axis of the bore, and that is in communication with bore 252, and with a secondary slot 274 that is in communication with the bore and with the primary slot. Slot 274 extends from the end of the primary slot that is located away from the mouth of the bore in a direction that is generally perpendicular to the axis of the primary slot, so that the slide pin may be manually moved from the end of the primary slot away from the mouth of bore along the secondary slot to lock the insert in place within the bore.

Figure 12:
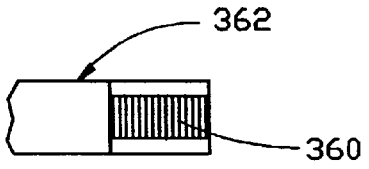
FIG. 12 is a sectional view of a portion of the shaft engagement means of the embodiment of the invention that is illustrated in FIGS. 10 and 11, as viewed from the perspective of lines 12—12 of FIG. 10.

FIGS. 10, 11 and 12 illustrate a fourth embodiment 342 of the invention, which may be used for quick and secure attachment and easy detachment of any accessory having a threaded shaft at one end, such as shaft 44 of FIGS. 2 and 3.

Mechanism 342 includes body 350, which is adapted for threaded insertion into a threaded accessory hole of a bow, by means of bolt 352. Jam nut 353 is also provided, which may be tightened to hold the mechanism securely on the bow. The body of mechanism 342 could also be incorporated within the riser of a bow such as bow 20, and in such case, mechanism 342 would be quite similar to mechanism 142 of FIGS. 4, 5 and 6.

Body 350 has a bore 354 extending therein, which bore is sized so that the shaft of the accessory may be inserted therein. As shown in FIGS. 10 and 11, the bore has a generally cylindrical cross-section, and it should also have a diameter that is at least as large as the major diameter of the shaft of the accessory, so that the shaft may be inserted therein. Preferably, bore 354 extends into the body to a depth at least as great as the length of the threaded shaft of the accessory.

Body 350 of mechanism 342 is also provided with a cavity that is located adjacent to and in communication with the bore. As shown in FIGS. 10 and 11, this cavity may be provided in the form of an elongate slot 356 that communicates with bore 354. Mechanism 342 also includes shaft engagement means within the body which are adapted to engage the threads of the shaft of the accessory within bore 354, and manually operable release means within the body which may be actuated to release the engagement means from the shaft.

The shaft engagement means of mechanism 342 includes pivoting arm 358 having a plurality of thread-engaging teeth 360 at first end 362. Preferably, the teeth are provided in the form of 0.3125–24 threads that are cut into first end 362, similar to threads 160 of FIG. 6. In the alternative, the teeth may be cut so as to be inclined away from the mouth of bore 354 at the periphery of the body, in the manner of teeth 160A of FIG. 7, or in any other convenient configuration.

Arm 358 is pivotally attached to the body, by means of pin 364 that is inserted through pivoting arm pinhole 366 and secured in body pinholes 368 and 370. Pin 364 permits arm 358 to be pivoted from an engaged position in which the teeth engage the threads of a shaft in bore 354 to a released position in which the teeth are released from engagement with the threads.

Mechanism 342 also includes biasing means adapted to apply a biasing force to arm 358 to urge first end 362 into elongate slot 356 so that thread-engaging teeth 360 will engage the threads on a shaft in the bore. Preferably, the biasing means is provided in the form of compression spring 372, as shown in FIGS. 10 and 11, which is disposed in spring cavity 374 in the body and placed around spring pin 376 of second end 378 of the pivoting arm.

The release means of mechanism 342 includes second end 378 which is manually engageable at knurled portion 380 to cause pivoting arm 358 to pivot first end 362 from the engaged position in which the teeth engage the threads of a shaft in the bore to the released position in which said teeth are released from engagement with said threads.

Although the portion of the embodiment of the invention illustrated in FIGS. 10 and 11 includes compression spring 372, the biasing means may be provided by any other means known to those skilled in the art to which the invention relates, such as in the form of a torsion spring (not shown) that may be mounted around pin 364. Such a spring will act to urge second end 378 away from body 350, and thereby to urge first end 362 inwardly into elongate slot 356 to the engaged position. However, regardless of the biasing means employed, the action of the biasing means permits teeth 360 of first end 362 to be disposed within the bore in the engaged position shown in FIG. 11 unless knurled portion 380 of second end 378 is depressed against the bias of the biasing means to move the first end 362 out of slot 356 to the released position.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. A quick-release locking mechanism for attachment of an accessory having a threaded shaft at one end thereof to an archer's bow, which mechanism comprises:

(a) a body having a bore extending therein, said body being provided with a threaded bolt that may be threaded into a threaded hole in a bow for attachment to the bow and said bore being sized so that the shaft of the accessory may be inserted therein;

(b) shaft engagement means within the body which are adapted to engage the threads of the shaft of the accessory within the bore; and (c) manually operable release means within the body which may be actuated to release the engagement means from the shaft.

2. The quick-release locking mechanism of claim 1, wherein:

(a) the body has a first bore and a second bore extending therein;

(i) said first bore having a generally cylindrical cross-section with a diameter that is at least as large as the major diameter of the shaft of the accessory, so that said shaft may be inserted therein;

(ii) said second bore having an axis that is disposed transverse to the axis of the first bore and intersecting therewith; and wherein (b) the shaft engagement means and release means comprise:

(i) a plunger that is disposed within the second bore and adapted for movement within and along said bore, said plunger having an outer end that is manually accessible from the periphery of said body and an inner end that is disposed within said body and an axis extending between said outer end and said inner end, said plunger having an aperture therethrough that is transverse to the axis of the plunger and located between said outer and inner ends, said aperture having an inner and an outer portion;

(A) said inner portion being located adjacent to the inner end portion of the plunger and having a partially cylindrical cross-section that is provided with threads adjacent to said inner end portion, said threads being adapted for engagement with the threads of the shaft, said inner portion having a major diameter at least as large as the major diameter of the shaft of the accessory;

(B) said outer portion adjacent to the outer end of the plunger having a cross-section which is at least as wide as the major diameter of the inner portion;

wherein said plunger is moveable within the second bore between an engaged position, with the inner portion of said aperture in alignment with the first bore to permit partial engagement of the threads of the shaft of an accessory inserted within said first bore with the threads of said inner portion of the aperture, to a released position, with the outer portion of the aperture in at least partial alignment with the first bore to permit axial movement of the threaded shaft on an accessory within said first bore;

(ii) biasing means adapted to apply a biasing force to the plunger to urge said plunger outwardly in an axial direction along the second bore to said engaged position;

(iii) retaining means adapted to maintain the plunger within the second bore;

whereby the plunger is disposed within the second bore in the engaged position unless the outer end of the plunger is depressed against the bias of the biasing means to move the plunger to the released position.

3. The quick-release locking mechanism of claim 2, wherein the first bore extends into the body to a depth at least as great as the length of the threaded shaft of the accessory.

4. The quick-release locking mechanism of claim 2, wherein the inner portion of the aperture of the plunger has a partially cylindrical cross-section that is provided with internal threads through a cross-sectional arc of at least about 22.5° and no more than 180°.

5. The quick-release locking mechanism of claim 2, wherein the second bore is generally cylindrical.

6. The quick-release locking mechanism of claim 2, wherein the second bore is non-cylindrical.

7. The quick-release locking mechanism of claim 2, wherein the biasing means is selected from the group consisting of torsion springs, compression springs and washers that resist compression.

8. The quick-release locking mechanism of claim 2, wherein the retaining means comprises a slot in the plunger between the aperture and the outer end thereof and a pin that is fixed within the body and extending transversely into the slot so that the axial movement of the plunger within the second bore is limited by the length of the slot along the axis of the second bore.

9. The quick-release locking mechanism of claim 8, wherein the pin is selected from the group consisting of roll pins, split-roll pins and dog-point set screws.

10. An archer's bow which comprises:

(a) a riser;

(b) a handgrip on the riser;

(c) a pair of limbs which extend from the riser in opposite directions generally along the long axis of the riser;

(d) a string, one end of which is attached at the outer end of each limb;

(e) a quick-release locking mechanism for attachment of an accessory having a threaded shaft at one end thereof to the bow, said mechanism being incorporated within the riser, which mechanism comprises:

(a) a body having a bore extending therein, said bore being sized so that the shaft of the accessory may be inserted therein;

(b) shaft engagement means within the body which are adapted to engage the threads of the shaft of the accessory within the bore; and (c) manually operable release means within the body which may be actuated to release the engagement means from the shaft.

11. The bow of claim 10, wherein:

(a) the body of the quick-release locking mechanism has a first bore and a second bore extending therein;

(i) said first bore having a generally cylindrical cross-section with a diameter that is at least as large as the major diameter of the shaft of the accessory, so that said shaft may be inserted therein;

(ii) said second bore having an axis that is disposed transverse to the axis of the first bore and intersecting therewith; and wherein (b) the shaft engagement means and release means of the quick-release locking mechanism comprise:

(i) a plunger that is disposed within the second bore and adapted for movement within and along said bore, said plunger having an outer end that is manually accessible from the periphery of said body and an inner end that is disposed within said body and an axis extending between said outer end and said inner end, said plunger having an aperture therethrough that is transverse to the axis of the plunger and located between said outer and inner ends, said aperture having an inner and an outer portion;

(A) said inner portion being located adjacent to the inner end portion of the plunger and having a partially cylindrical cross-section that is provided with threads adjacent to said inner end portion, said threads being adapted for engagement with the threads of the shaft, said inner portion having a major diameter at least as large as the major diameter of the shaft of the accessory;

(B) said outer portion adjacent to the outer end of the plunger having a cross-section which is at least as wide as the major diameter of the inner portion;

wherein said plunger is moveable within the second bore between an engaged position, with the inner portion of said aperture in alignment with the first bore to permit partial engagement of the threads of the shaft of an accessory inserted within said first bore with the threads of said inner portion of the aperture, to a released position, with the outer portion of the aperture in at least partial alignment with the first bore to permit axial movement of the threaded shaft on an accessory within said first bore;

(ii) biasing means adapted to apply a biasing force to the plunger to urge said plunger outwardly in an axial direction along the second bore to said engaged position;

(iii) retaining means adapted to maintain the plunger within the second bore;

whereby the plunger is disposed within the second bore in the engaged position unless the outer end of the plunger is depressed against the bias of the biasing means to move the plunger to the released position.

12. The bow of claim 11, wherein the first bore extends into the body to a depth at least as great as the length of the threaded shaft of the accessory.

13. The bow of claim 11, wherein the inner portion of the aperture of the plunger has a partially cylindrical cross-section that is provided with internal threads through a cross-sectional arc of at least about 22.5° and no more than 180°.

14. The bow of claim 11, wherein the second bore is generally cylindrical.

15. The bow of claim 11, wherein the second bore is non-cylindrical.

16. The bow of claim 11, wherein the biasing means is selected from the group consisting of torsion springs, compression springs and washers that resist compression.

17. The bow of claim 11, wherein the retaining means comprises a slot in the plunger between the aperture and the outer end thereof and a pin that is fixed within the body and extending transversely into the slot so that the axial movement of the plunger within the second bore is limited by the length of the slot along the axis of the second bore.

18. The bow of claim 11, wherein the pin is selected from the group consisting of roll pins, split-roll pins and dog-point set screws.

19. The bow of claim 10, wherein:

(a) the body of the quick-release locking mechanism is provided with a cavity that is located adjacent to and in communication with the bore; and (b) the shaft engagement means of the quick-release locking mechanism comprises an elongate arm having a plurality of inclined thread-engaging teeth thereon, which arm is pivotally attached to the body so that said arm may be pivoted from an engaged position in which the teeth engage the threads of a shaft in the bore to a released position in which said teeth are released from engagement with said threads; and (c) the release means of the quick-release locking mechanism comprises an arm projection which is connected to the elongate arm and projects from the elongate arm outwardly from the body to a terminal knob which is manually engageable to cause the arm projection to pivot the elongate arm from the engaged position in which the teeth engage the threads of a shaft in the bore to the released position in which said teeth are released from engagement with said threads.

20. The bow of claim 19, wherein:

(a) the elongate arm has a first end and a second end; and (b) the arm pivots about a point located between the first end and the second end; and (c) the thread-engaging teeth are located generally between the first end and the pivot point; and (d) said quick-release locking mechanism includes biasing means adapted to apply a biasing force to the second end of the elongate arm to urge said arm to pivot to its first position; and (e) the arm projection is connected to the second end of the elongate arm and disposed in opposition to the biasing means so that the terminal knob may be depressed to overcome the biasing force and move the elongate arm to the released position.

21. The bow of claim 10, wherein:

(a) the body of the quick-release locking mechanism includes:

(i) the bore extending therein, said bore tapering inwardly from a mouth thereof at the periphery of the body, wherein:

(A) said mouth has a diameter that is larger than the major diameter of the shaft; and (B) the width of the bore decreases as the bore tapers inwardly from the mouth thereof, so that the width of the bore, at a point within the body located a distance from the mouth that is greater than the defined length, is smaller than the major diameter of the shaft;

(ii) a slot that extends generally along the axis of the bore, said slot being in communication with said bore; and wherein (b) the shaft engagement means of the quick-release locking mechanism comprises an insert that is adapted to fit within the tapered bore, which insert includes:

(i) a base portion having a width that is not larger than the major diameter of the shaft;

(ii) a plurality of projections, each of which:

(A) has a first end and a second end;

(B) is attached to the base portion at the first end so that the second end is disposed towards the mouth of the bore in a direction generally along the inner surface of the bore;

(C) is spaced around the periphery of the base portion;

(D) is provided with a plurality of thread engaging means that are adapted to engage the threads of the shaft; and wherein (c) the release means of the quick-release locking mechanism comprises a slide pin which is attached to the insert and which extends through the slot in a direction transverse to the axis of the bore, said slide pin being adapted to move the insert axially along the bore so that the second end of the projections will move apart as the base portion of the insert is moved towards the mouth of the bore, with said axial movement of the insert being limited by the length of the slot along the axis of the tapered bore.

22. The bow of claim 21, wherein the insert is provided in the form of a collet having internal threads therein that are adapted to engage the threads of the shaft.

23. The bow of claim 21, wherein the body of the quick-release locking mechanism has:

(a) primary slot that extends generally along the axis of the bore, said slot being in communication with said bore so that the slide pin which is attached to the insert and which extends through the slot in a direction transverse to the axis of the bore may be manually moved along the primary slot to move the insert axially along the bore, with said axial movement of the insert being limited by the length of the primary slot along the axis of the tapered bore; and (b) a secondary slot that is in communication with the bore and with the primary slot and which extends from the end of the primary slot away from the mouth of the bore in a direction that is generally perpendicular to the axis of the primary slot, so that the slide pin may be manually moved from the end of the primary slot away from the mouth of bore along the secondary slot to lock the insert in place within the bore.

24. A method for attachment of an accessory having a threaded shaft at one end thereof to an archer's bow, which method comprises:

(a) providing a quick-release locking mechanism for attachment of an accessory having a threaded shaft at one end thereof to the bow, which mechanism comprises:

(i) a body having a bore extending therein, said bore being sized so that the shaft of the accessory may be inserted therein;

(ii) shaft engagement means within the body which are adapted to engage the threads of the shaft of the accessory within the bore; and (iii) manually operable release means within the body which may be actuated to release the engagement means from the shaft;

(b) actuating the release means to prevent interference between said release means and the threaded shaft of the accessory during insertion of the shaft into the bore;

(c) inserting the shaft of the accessory into the bore;

(d) actuating the shaft engagement means to engage the threads of the shaft of the accessory within the bore.

25. The method of claim 24, which method includes:

(a) providing a quick-release locking mechanism for attachment of an accessory having a threaded shaft at one end thereof to the bow, which mechanism comprises:

(i) a body having a first bore and a second bore extending therein;

(A) said first bore having a generally cylindrical cross-section with a diameter that is at least as large as the major diameter of the shaft of the accessory, so that said shaft may be inserted therein;

(B) said second bore having an axis that is disposed transverse to the axis of the first bore and intersecting therewith;

(ii) a plunger that is disposed within the second bore and adapted for movement within and along the axis of said bore, said plunger having an outer end that is manually accessible from the periphery of said body and an inner end that is disposed within said body and an axis extending between said outer end and said inner end, said plunger having an aperture therethrough that is transverse to the axis of the plunger and located between said outer and inner ends, said aperture having an inner and an outer portion;

(A) said inner portion being located adjacent to the inner end portion of the plunger and having a partially cylindrical cross-section that is provided with threads adjacent to said inner end portion, said threads being adapted for engagement with the threads of the shaft, said inner portion having a major diameter at least as large as the major diameter of the shaft of the accessory;

(B) said outer portion adjacent to the outer end of the plunger having a cross-section which is at least as wide as the major diameter of the primary portion;

wherein said plunger is moveable within the second bore between an engaged position, with the inner portion of said aperture in alignment with the first bore to permit partial engagement of the threads of the shaft of an accessory inserted within said first bore with the threads of said inner portion of the aperture, to a released position, with the outer portion of the aperture in at least partial alignment with the first bore to permit axial movement of the threaded shaft on an accessory within said first bore;

(iii) biasing means adapted to apply a biasing force to the plunger to urge said plunger outwardly in an axial direction along the second bore to said engaged position;

(iv) retaining means adapted to maintain the plunger within the second bore;

whereby the plunger is disposed within the second bore in the engaged position unless the outer end of the plunger is depressed against the bias of the biasing means to move the plunger to the released position;

(b) inserting the shaft of the accessory into the first bore while depressing the outer end of the plunger against the bias of the biasing means to move the plunger to the released position;

(c) releasing the plunger to permit the biasing means to move the plunger to the engaged position.

26. The method of claim 25, wherein after the plunger is released to permit the biasing means to move the plunger to the engaged position, the accessory is turned in a radial direction to tighten the threads of the shaft into the quick-release locking mechanism.

27. The method of claim 24, which method includes:

(a) providing a quick-release locking mechanism for attachment of an accessory having a threaded shaft at one end thereof to the bow, which mechanism comprises:

(i) a body having a bore and a cavity that is located adjacent to and in communication with the bore; and (ii) a shaft engagement means which comprises an elongate arm having a plurality of inclined thread-engaging teeth thereon, which arm is pivotally attached to the body so that said arm may be pivoted from an engaged position in which the teeth engage the threads of a shaft in the bore to a released position in which said teeth are released from engagement with said threads; and (iii) a release means which comprises an arm projection that is connected to the elongate arm and which projects from the elongate arm outwardly from the body to a terminal knob which is manually engageable to cause the arm projection to pivot the elongate arm from the engaged position in which the teeth engage the threads of a shaft in the bore to the released position in which said teeth are released from engagement with said threads;

(b) inserting the shaft of the accessory into the bore so that the thread engaging means will engage the threads of the shaft to lock the shaft within the body.

28. The method of claim 24, which method includes:

(a) providing a quick-release locking mechanism for attachment of an accessory having a threaded shaft of defined length at one end thereof to the bow, which mechanism comprises:

(i) a body having:

(A) a bore extending therein, said bore tapering inwardly from a mouth thereof at the periphery of the body, wherein:

(1) said mouth has a diameter that is larger than the major diameter of the shaft; and (2) the width of the bore decreases as the bore tapers inwardly from the mouth thereof, so that the width of the bore, at a point within the body located a distance from the mouth that is greater than the defined length, is smaller than the major diameter of the shaft;

(B) a slot that extends generally along the axis of the bore, said slot being in communication with said bore;

(ii) an insert that is adapted to fit within the tapered bore, said insert comprising:

(A) a base portion having a width that is not larger than the major diameter of the shaft;

(B) a plurality of projections, each of which:

(1) has a first end and a second end;

(2) is attached to the base portion at the first end so that the second end is disposed towards the mouth of the bore in a direction generally along the inner surface of the bore;

(3) is spaced around the periphery of the base portion;

(4) is provided with a plurality of thread engaging means that are adapted to engage the threads of the shaft;

(iii) a slide pin which is attached to the insert and which extends through the slot in a direction transverse to the axis of the bore, said slide pin being adapted to move the insert axially along the bore so that the second end of the projections will move apart as the base portion of the insert is moved towards the mouth of the bore, with said axial movement of the insert being limited by the length of the slot along the axis of the tapered bore;

(b) engaging the slide pin to move the insert so that the base portion thereof moves towards the mouth of the bore;

(c) inserting the shaft of the accessory into the bore, while engaging the slide pin to move the insert and the shaft axially into the bore so that the thread engaging means will engage the threads of the shaft to lock the shaft within the body.

* * * * *